US007673636B2

(12) United States Patent
Pires et al.

(10) Patent No.: US 7,673,636 B2
(45) Date of Patent: Mar. 9, 2010

(54) POWDER CONTAINER

(75) Inventors: Leo Clifford Pires, Basking Ridge, NJ (US); Roger Hwang, Maple (CA); Iti Seth, New Delhi (IN); Rahul Bose, New Delhi (IN); Koushik Kohli, Ghaziabed (IN)

(73) Assignee: Zen Design Solutions Limited, Hong Kong (HK)

( * ) Notice: Subject to any disclaimer, the term of this patent is extended or adjusted under 35 U.S.C. 154(b) by 641 days.

(21) Appl. No.: 11/518,817

(22) Filed: Sep. 11, 2006

(65) Prior Publication Data

US 2008/0060674 A1 Mar. 13, 2008

(51) Int. Cl.
*A45D 33/02* (2006.01)

(52) U.S. Cl. ..... 132/306; 132/307

(58) Field of Classification Search ..... 132/293, 132/294, 298, 299, 307, 313, 306, 297; 15/111, 15/106; 401/99, 101, 110, 111, 112, 116, 401/129

See application file for complete search history.

(56) References Cited

U.S. PATENT DOCUMENTS 6,474,346 B1 * 11/2002 Jang ..... 132/307
6,764,239 B2 * 7/2004 Kim ..... 401/108
6,799,582 B2 * 10/2004 Kim ..... 132/317
6,883,990 B2 * 4/2005 Shih ..... 401/127
2008/0092916 A1 * 4/2008 Song ..... 132/294

* cited by examiner

*Primary Examiner*—Robyn Doan
*Assistant Examiner*—Brianne E O'Neill
(74) *Attorney, Agent, or Firm*—Patterson & Sheridan, LLP

(57) ABSTRACT

A loose powder container is provided. The powder container includes a cap and a receptacle for storing the loose powder. The cap includes a brush integrated into the cap. The cap also comprises two sections, such that, in an initial position an upper section is aligned with respect to a lower section of the cap. Clockwise rotation of the upper section in order to mis-align it with the lower section of the cap, results in the brush protruding from the cap. The brush is completely protruded when the upper section of the cap is re-aligned with the lower section of the cap upon a 180 degree rotation in the clockwise direction. The fully protruded brush is twirled around to pick loose powder through a perforated layer comprised in the receptacle. The brush is retracted upon anti-clockwise rotation of the upper section, to align it in the initial position with the lower section.

10 Claims, 8 Drawing Sheets

POWDER CONTAINER

FIELD OF THE INVENTION

The present invention relates generally to containers for powder. More specifically, the present invention relates to a container for cosmetic powder having an integrated applicator.

BACKGROUND

Powder is a solid substance in the form of tiny loose particles. Powder that is used for application on the human body, especially the face, is known as cosmetic powder.

Cosmetic powder is mainly available in two forms—compressed or compact, and loose. Compressed cosmetic powder has a consistent solid cake form and it is usually packaged in flat-shaped compact cases. Typically, the case also includes a puff or a brush to help a user to apply the powder. A puff is a soft applicator device made from fluffy or deformable fibers. Whereas, a brush is an applicator device with a tuft of hair or bristles that is firmly attached to a holder. The puff or brush is rubbed over the compact powder surface to loosen some surface powder. The loosened powder sticks to the applicator device, which is then applied to the face.

However, loose powder as the name suggests, is loose and therefore it must be specially contained to avoid its spilling. Conventionally, loose powder is contained in a dispenser with a multiplicity of perforations on one end of the dispenser. A cap is provided to seal the perforations and to prevent spilling of the powder. For application, the cap is removed and the powder is shaken out of the perforations directly onto a puff, or into a dish from which it is picked up by a puff or a brush. This may lead to a waste of powder in case when excess powder is dispensed than what is required for application. Additionally, the loose powder may fall out from the perforations into the cap during handling or transportation of the powder dispenser resulting in a mess when the cap is removed.

Moreover, an applicator is required to be carried separately. This results in extra space requirements in order to store the applicator. If not handled appropriately, the applicator may also be deformed.

It is apparent from the above discussion that there is a need for a powder container having an integrated applicator and which addresses the stated shortcomings.

SUMMARY OF THE INVENTION

The shortcomings set forth above are addressed by the present invention which is a loose powder container including a brush for application of the powder.

It is an object of the invention to provide a loose powder container comprising an applicator brush, so that a user is not required to carry an applicator separately.

Another object of the invention is to provide a container for loose powder and a brush integrated with the container, so that a user may directly use the brush to apply the powder from the container without the need to dispense the powder onto an external surface.

Still another object of the invention is to provide a loose powder container which incorporates an apparatus to prevent the spilling of the loose powder during handling of the container.

Yet another object of the invention is to provide an apparatus to protect the bristles of the brush from being deformed resulting from continuous contact with its surroundings.

Yet another object of the invention is to provide an ergonomic powder applicator.

The present invention is a container for loose powder having an integrated applicator brush. The container comprises a receptacle and a cap. The receptacle stores powder and also includes a perforated panel through which powder can be picked up for application. The cap securely seals the receptacle through a sealing means. The cap also has a brush integrated into the cap and a rotational means to effect the protrusion and retraction of the brush. The cap is further comprised of an upper section and a lower section such that the upper section and the lower section are aligned with respect to each other in an initial position. In this initial position, the brush is in a retracted state in the cap. A user can remove the cap from the receptacle and rotate the upper section with respect to the lower section of the cap in a first direction to misalign the two sections. This misalignment of the upper section and the lower section in the first direction results in the brush to protrude from the cap. The brush is completely protruded once the upper section and the lower section are re-aligned at 180 degrees in the first direction. The user can then twirl the fully protruded brush inside the receptacle over the perforated panel to pick powder for application. Once the powder has been applied using the protruded brush, the upper section is rotated in the reverse direction to align with the lower section in the initial position, in which position the brush is completely retracted into the cap. The cap is then screwed onto the receptacle.

BRIEF DESCRIPTION OF THE DRAWINGS

The various features and advantages of the present invention will be appreciated, as they become better understood by reference to the following detailed description when considered in connection with the accompanying drawings, wherein.

DETAILED DESCRIPTION OF THE DRAWINGS

The present invention provides a container for loose powder. The powder container includes a cap that securely seals the container through a sealing apparatus. The cap is split into two sections which are aligned with respect to each other in an initial position. A brush is integrated into at least one of the sections of the cap, thereby eliminating the need for a user to carry a powder applicator separately. Once the cap has been unscrewed from the container, an upper section of the cap can be rotated with respect to a lower section of the cap to extend or protrude the brush so that the user may apply the powder using the protruded brush.

Figure 1:
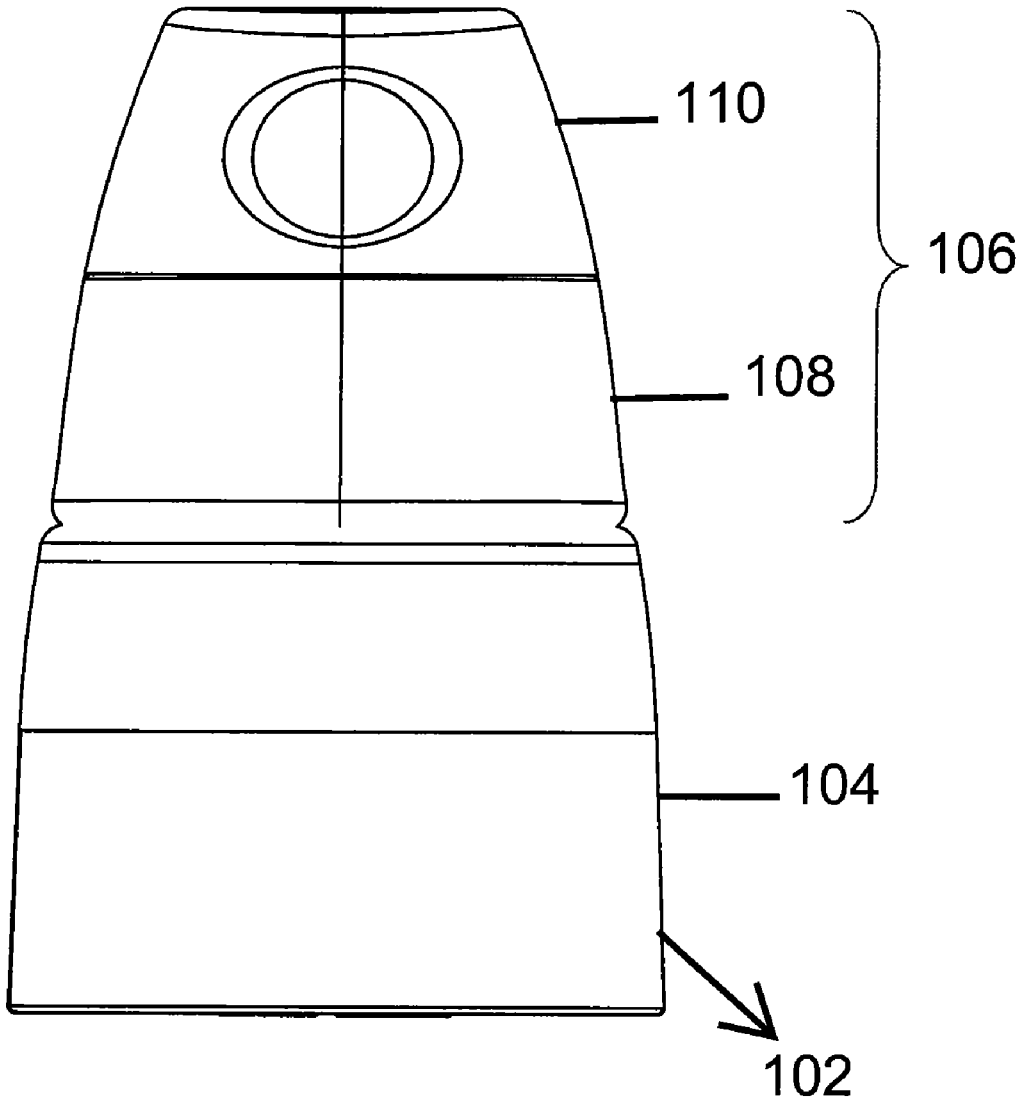
FIG. 1 is a front view of a powder container in accordance with an embodiment of the present invention.

FIG. 1 is a front view of a powder container 102 in accordance with an embodiment of the present invention. Powder container 102 includes a receptacle 104 and a cap 106. Receptacle 104 contains loose powder. Further, receptacle 104 includes a perforated panel through which powder can be picked up by a brush for application. In an embodiment, receptacle 104 is also called outer jar. Additionally, in an embodiment, the perforated panel is called the inner jar. Cap 106 securely seals receptacle 104 through a sealing apparatus. Cap 106 includes a brush integrated into cap 106. This brush is positioned in a retracted state inside cap 106 when cap 106 seals the receptacle 104. Further, cap 106 includes two sections, an upper section 110 and a lower section 108. Upper section 110 is movable relative to lower section 108 through a rotational apparatus of the cap 106. In accordance with an embodiment cap 106 has an ergonomic shape to enable a user to easily grip rotational apparatus of the cap 106. In accordance with an embodiment, and the cap 106 and handle the cap.

Figure 2A:
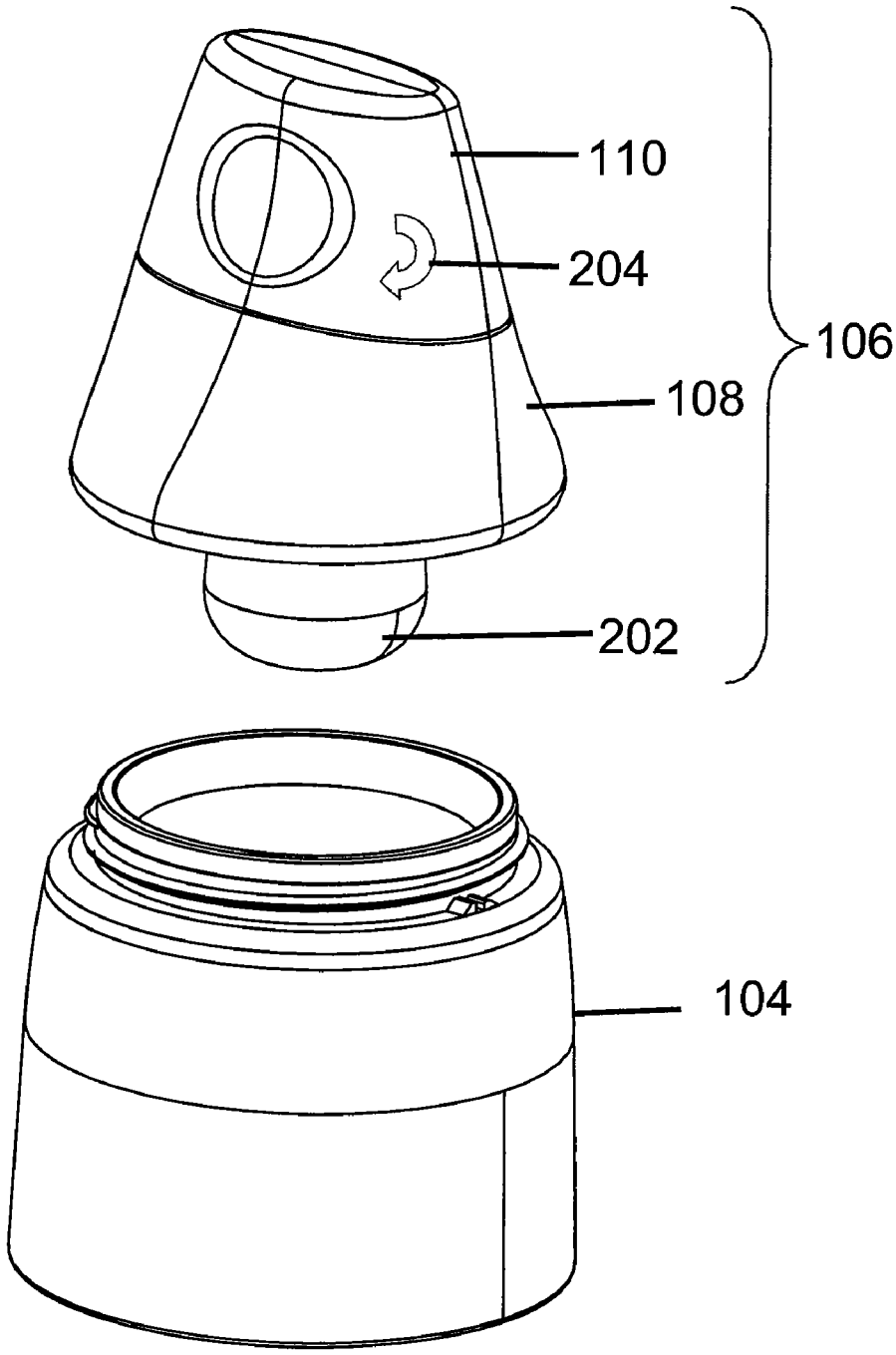
FIG. 2A illustrates a perspective view of the powder container with a cap unscrewed from a receptacle and an upper section and a lower section of the cap aligned with respect to each other in an initial position in accordance with an embodiment of the present invention.

FIG. 2A illustrates the powder container with the cap 106 unscrewed and separated from the receptacle in accordance with an embodiment of the present invention. Cap 106 includes a brush 202, which is illustrated in the figure to be integrated into the cap. Brush 202 can be protruded or extended from and retracted into cap 106. This is achieved by aligning or by misaligning upper section 110 and lower section 108 of cap 106 through the rotational apparatus of the cap. Upper section 110 and lower section 108 of cap 106 are illustrated to be in an aligned arrangement in FIG. 2A. In this initial arrangement, the brush is positioned inside the cap in a retracted state. Brush 202 is received into receptacle 104 in a retracted state when cap 106 seals receptacle 104. In accordance with an embodiment, brush 202 is formed of a tuft of bristles which has an approximate pear shape. In accordance with an embodiment, the tuft may be formed from either synthetic or natural bristles.

Figure 2B:
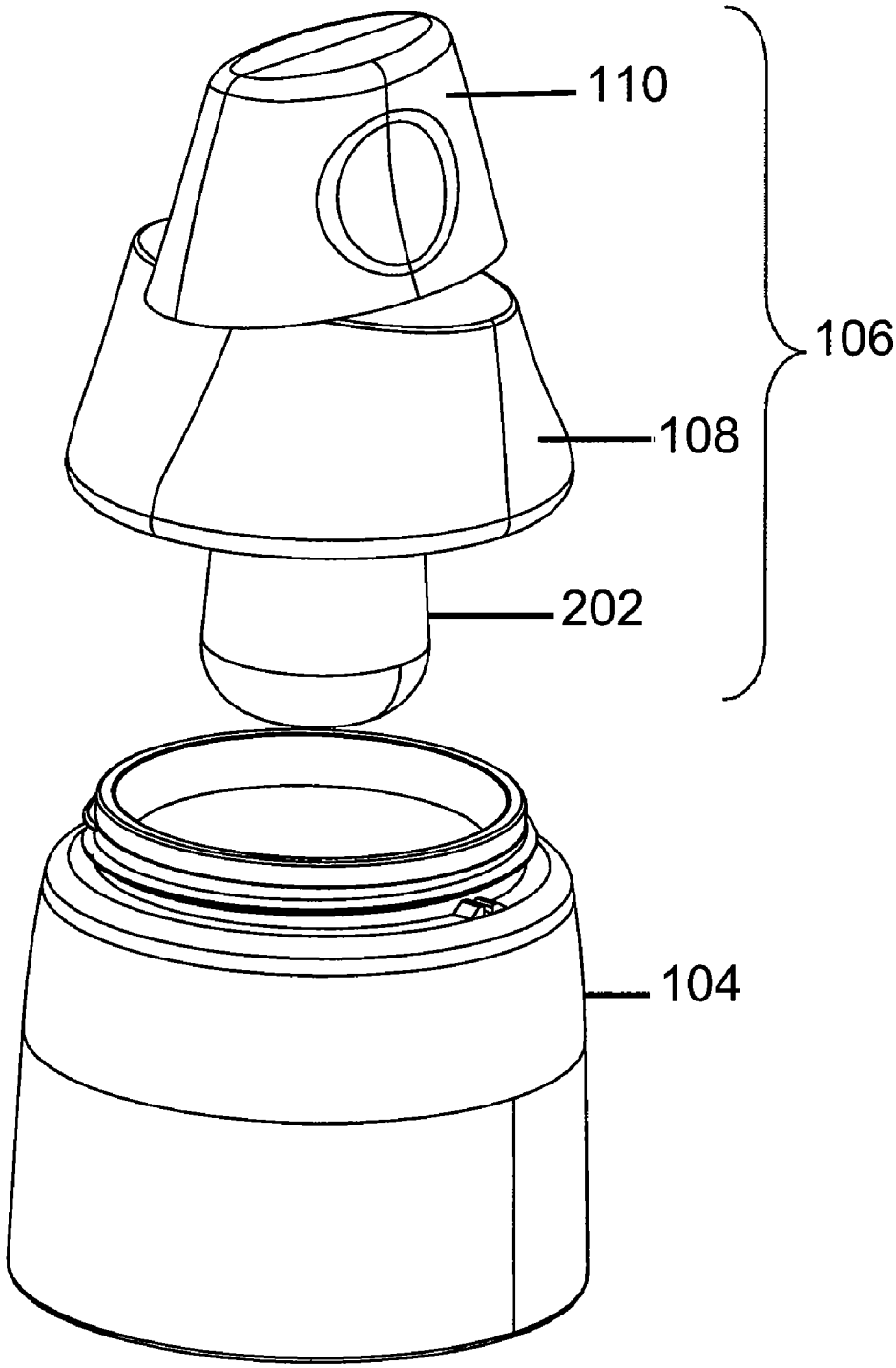
FIG. 2B illustrates the powder container with the cap unscrewed and the upper section and the lower section of the cap rotated with respect to each other in a predetermined direction to be in a misaligned arrangement to protrude a brush.

FIG. 2B illustrates the powder container with the cap unscrewed and upper section 110 and lower section 108 rotated with respect to each other to be in a misaligned arrangement to protrude or extend brush 202. Once a user unscrews cap 106, the brush is in a retracted position within the cap. In this initial position, upper section 110 and lower section 108 are in an aligned arrangement with respect to each other (as illustrated in FIG. 2A). To protrude or extend brush 202, the user rotates upper section 110 with respect to lower section 108 in a predetermined direction. In accordance with an embodiment, upper section 110 is rotated in a clockwise direction. FIG. 2B illustrates a half-rotation between upper section 110 and lower section 108, where both sections are misaligned at approximately 90 degrees with respect to each other. In this arrangement, brush 202 is in the process of being protruded or extended from cap 106.

Figure 2C:
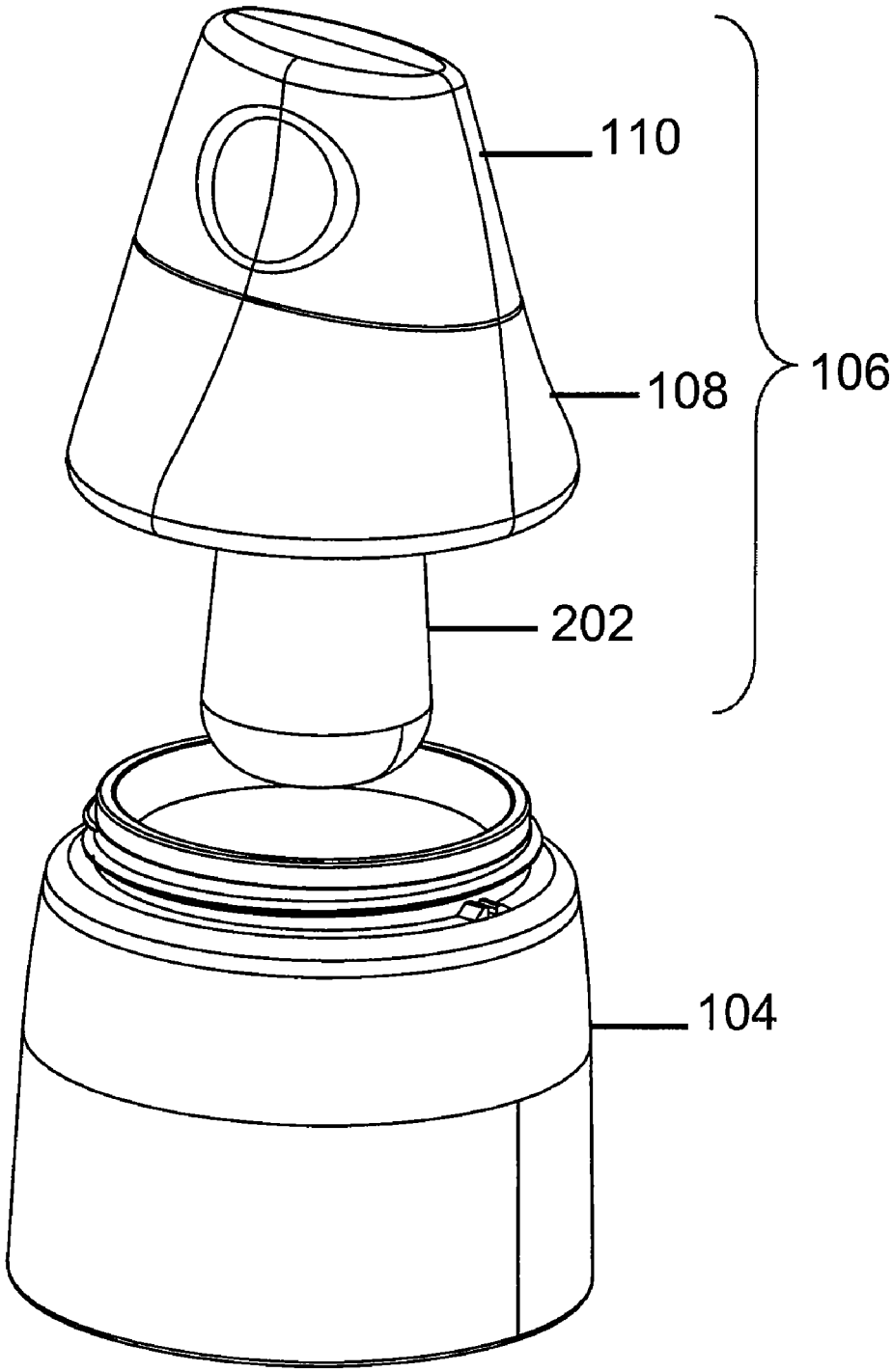
FIG. 2C illustrates the powder container with the cap unscrewed and the upper section and the lower section of the cap rotated with respect to each other to be completely realigned in the predetermined direction to completely protrude the brush.

FIG. 2C illustrates powder container 102 with cap 106 unscrewed and separated. Upper section 110 is completely rotated in order to be realigned at approximately 180 degrees with lower section 108, in which position, brush 202 is completely protruded or extended from cap 106. In accordance with this embodiment of the cap, there is no possibility for confusion for a user regarding the degree of rotation required to fully protrude or extend the brush. The form of the cap breaks or misaligns and then re-aligns to convey to the user that the rotation is complete and the brush is fully extended in that state. In accordance with an embodiment, the effective length of the bristles in a fully extended brush is approximately 23 mm, from the tip of the bristles to the top base of lower section 108. Other lengths are within the scope of the invention.

In accordance with an embodiment, a rotation complete indicator 204 is provided on the cap, which indicates the direction in which the user should rotate upper section 110 with respect to lower section 108. Further, rotation complete indicator 204 only permits the upper section 110 and the lower section 108 to be rotated for alignment and realignment to the extent of approximately 180 degrees and prevents further rotation between the two sections. In accordance with an embodiment of the cap, a stopper between upper section 110 and lower section 108 can prohibit further rotation of upper section 110 in the direction of its rotation, once upper section 110 is aligned with lower section 108 at 180 degrees.

Figure 3:
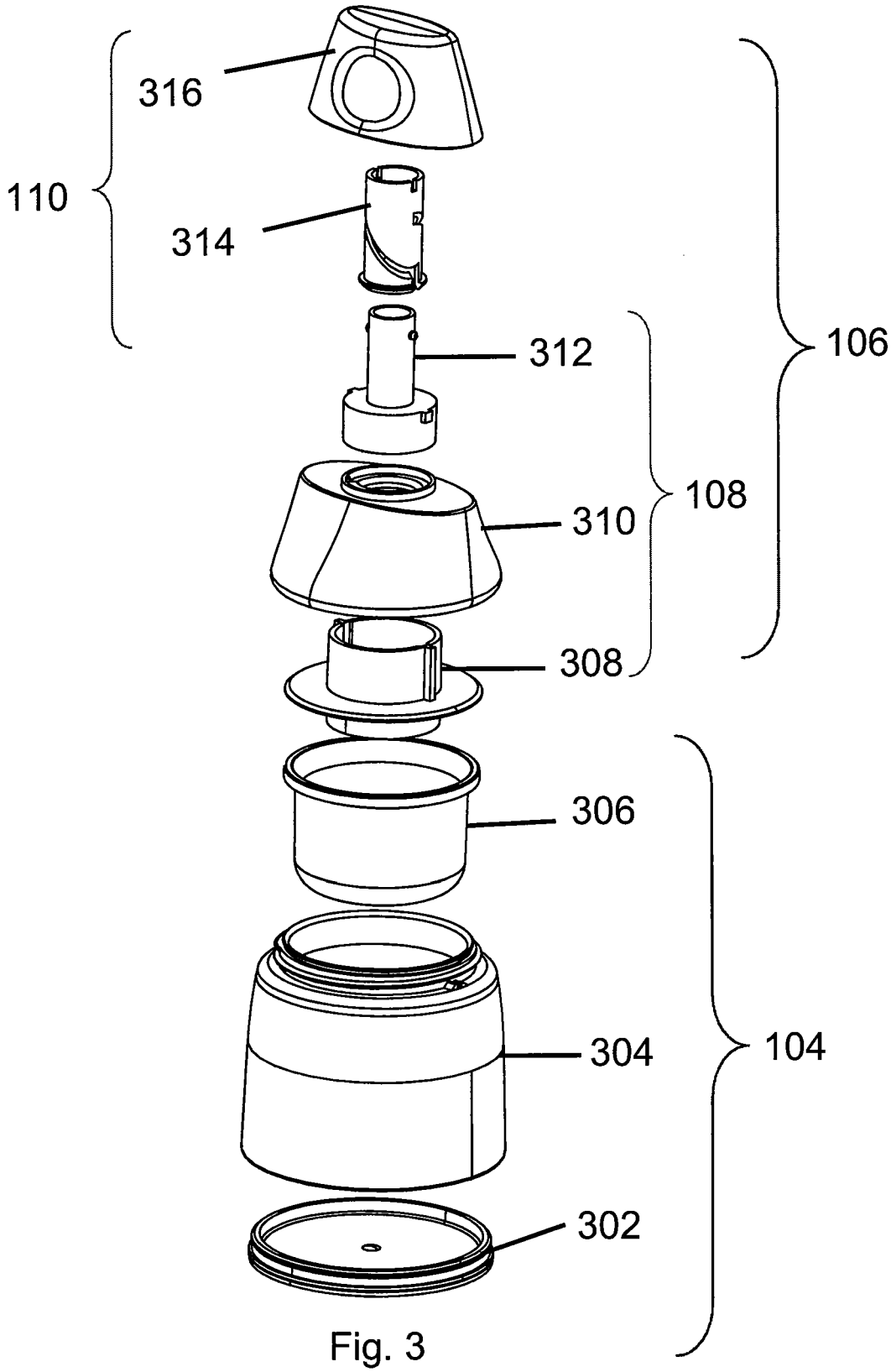
FIG. 3 is an exploded view of the loose powder container in accordance with an exemplary embodiment of the present invention.

FIG. 3 is an exploded view of the powder container in accordance with an exemplary embodiment of the present invention. Specifically, FIG. 3 illustrates the various components comprised in receptacle 104 and cap 106 in accordance with an embodiment. As illustrated in FIG. 3, receptacle 104 includes a bottom disc 302, an outer jar 304, and an inner jar 306.

Bottom disc 302 provides the base for outer jar 304 on which outer jar 304 can be positioned. In accordance with an embodiment, bottom disc 302 is made from Polypropylene or other suitable material. Bottom disc 302 can be detached from outer jar 304 to fill outer jar 304 with powder. Thus in accordance with an embodiment, bottom disc 302 affords a refilling apparatus for the loose powder container of the present invention.

Outer jar 304 is filled with powder and serves as the container for the powder. In accordance with an embodiment, outer jar 304 can be a pot-shaped circular jar with vertical sides and a narrow opening on the top. The shape of the outer jar 304 has been described in detail in conjunction with FIG. 4.

Outer jar 304 includes an inner jar 306 which is detachable from outer jar 304. Inner jar 306 is circular and has curved concave side walls. In accordance with an embodiment, inner jar 306 is made of Polypropylene or any suitable material. The bottom of inner jar 306 is substantially flat and includes perforations like a sieve. The perforations enable the powder in outer jar 304 to be picked through inner jar 306 by twirling brush 202 in it. In accordance with an embodiment, inner jar 306 includes the perforated panel of the receptacle 104 and through which powder can be picked up by brush 202. The shape of inner jar 306 has been described in further detail in conjunction with FIG. 5.

The various components which are comprised in cap 106 are now described. As described in conjunction with FIG. 1, cap 106 includes a lower section 108 and an upper section 110. In accordance with an embodiment, lower section 108 includes a seal disc 308, a lower cap 310 and a brush holder 312. Also, in accordance with an embodiment, upper section 110 includes a center bar 314 and an upper cap 316.

Seal disc 308 is attached to lower cap 310. In accordance with an embodiment seal disc 308 may be made of polypropylene. Seal disc 308 is a circular disc with a concentric hollow circle in its center. The concentric hollow circle is preferably surrounded by a circular and vertical wall with vertically protruding channels on two opposite sides. The hollow circular center of seal disc 308 enables a brush to pass through seal disc 308 to inner jar 306. The circular and vertical wall acts as a protective collar for the brush and its bristles. The brush protector collar protects the bristles of the brush from deformation when the brush protrudes and retracts. The vertically protruding channels on the circular and vertical wall enable seal disc 308 to permanently fit itself inside the inner wall of lower cap 310. The inner wall of lower cap 310 also includes hollow vertical channels to fit the protruding channels of seal disc 308.

Lower cap 310 is circular in shape and configured such that it fits onto the narrow opening on the top of outer jar 304. In accordance with an embodiment, lower cap 310 has helical grooves on the bottom part of its inner wall. These helical grooves cooperate or interface with the lower cap 310 with outer jar 304 to enable the sealing and opening of the powder container. However, the invention should not be construed to be limited to the use of interlocking helical grooves as the sealing apparatus means for the powder container. Other commonly known mechanisms can also be used for the purpose.

In accordance with an embodiment, lower cap 310 has a narrower shape on its top and widens towards its bottom. Also, in an embodiment, lower cap 310 is oval and flat in shape towards its top. Further, lower cap 310 is hollow in shape to allow a brush to pass through lower cap 310 into inner jar 306. In addition, the inner part of the flat top of lower cap 310 includes opposite pair of vertical hollow channels. These channels provide a mechanism to fit brush holder 312 to lower cap 310. In accordance with an embodiment lower cap 310 may be made of Acrylonitrile Butadiene Styrene (ABS).

Brush holder 312 has a circular base with a hollow circular center. Outer walls of the circular base have a pair of opposite protruding channels that fit into the vertical hollow channels of the flat top of lower cap 310. The hollow circular center of brush holder 312 is surrounded by a vertically protruding wall. The inner side of the vertically protruding wall holds the brush. The outer side of the vertically protruding wall of brush holder 312 has a pair of opposite protruding notches. These notches fit inside sliding channels on the vertical walls of center bar 314. In accordance with an embodiment brush holder 312 may be made of polypropylene.

Center bar 314 is a cylindrical device which has a spiral-shaped hollow channel on its wall. In accordance with an embodiment center bar 314 may be made of Acrylonitrile Butadiene Styrene (ABS). Protruding notches of brush holder 312 are engaged in the hollow channel. Center bar 314 is further attached to upper cap 316. Upper cap 316 is configured in an oval shape to match the shape of the upper part of lower cap 310. Upper cap 316 can be rotated with respect to lower cap 310. The brush is fixed to the inner top part of upper cap 316. In an embodiment, the inner top part of upper cap 316 is flat. The brush fixed inside upper cap 316 passes through center bar 314 and brush holder 312. In accordance with an embodiment upper cap 316 may be made of Acrylonitrile Butadiene Styrene (ABS).

The operation of the powder container for application of the powder is described hereafter in accordance with the embodiment described in FIG. 3. The powder container is opened by unscrewing cap 106 from receptacle 104, that is, lower cap 310 unscrews outer jar 304. A user rotates upper cap 316 in one direction. Upon rotating upper cap 316, center bar 314 also rotates. The rotation of center bar 316 causes the notches of brush holder 312 to slide down on its hollow spiral-shaped channel. The downward sliding movement causes the brush inside brush holder 312 to also slide downwards, hence causing the brush to protrude. In accordance with an embodiment, the rotation apparatus of cap 106 includes the center bar which when rotated causes the movement of the upper cap 316 with respect to the lower cap 310, both being comprised in cap 106. Further, the mechanism incorporated in the shape of the brush holder which causes the downward sliding movement of the brush upon rotation is the protrusion apparatus in accordance with the embodiment of the present invention. The rotation of upper section 110 and lower section 108 with respect to each other causing the resulting protrusion of brush 202 is not only limited to the mechanism described herein. Any other mechanism may be used for the purpose.

Figure 4:
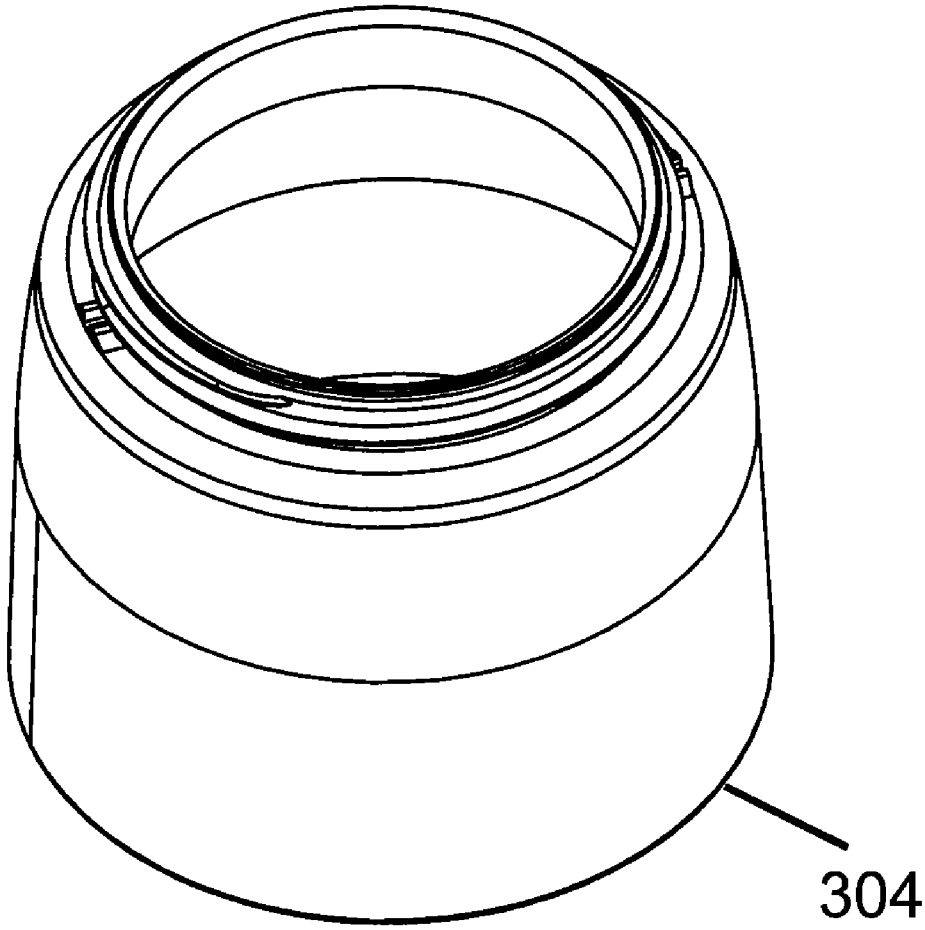
FIG.4 is a perspective view of an outer jar in accordance with an embodiment of the receptacle of the present invention.

FIG. 4 illustrates an outer jar in accordance with an embodiment of the receptacle of the present invention. The outer jar illustrated in FIG. 4 has a narrow opening at the top. This narrow opening may include helical grooves on its outer wall. The helical grooves provide an interfacing mechanism for locking cap 106 of the powder container with respect to the outer jar 304 and consequently with respect to receptacle 104. Alternatively, other commonly known interfacing mechanisms, such as a click-lock mechanism, can also be used for the sealing of the outer jar 304. In an embodiment, the narrow circular opening of outer jar 304 has a diameter of approximately 38 mm and the broader circular base of outer jar 304 has a diameter of approximately 50.8 mm. Also, in accordance with an embodiment, the height of outer jar 304 is approximately 43 mm. However, all the dimensions of outer jar 304 should not be construed to be limited to the numbers mentioned above. These dimensions may vary with other embodiments. Further, in accordance with an embodiment, outer jar 304 may be made of Styrene-Acrylonitrile.

Figure 5:
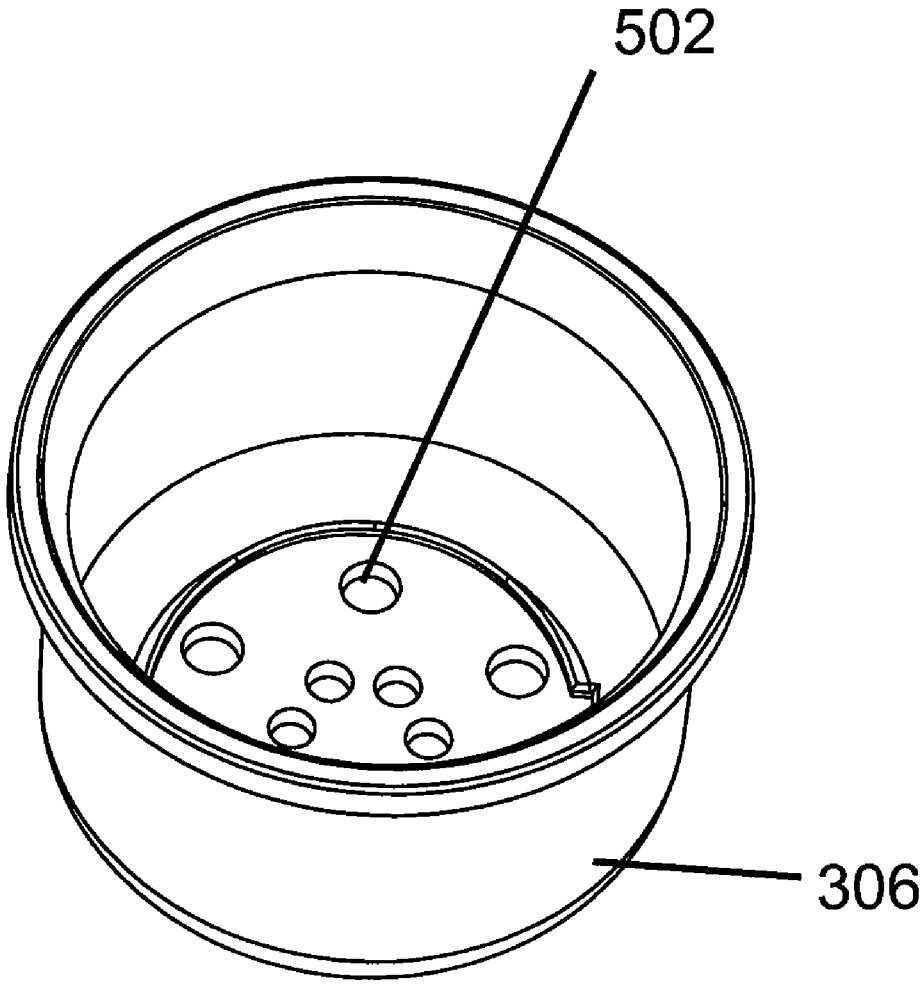
FIG. 5 is a perspective view of an inner jar in accordance with an embodiment of the receptacle of the present invention.

FIG. 5 illustrates an inner jar in accordance with an embodiment of the receptacle of the present invention. Inner jar 306 comprises perforations 502. In accordance with an embodiment, perforations 502 are small orifices. However other shapes of perforations can also be used. Additionally, the size of perforations 502 can be determined based on the utility of the powder container and the amount of powder desired for application. For instance, the size of the perforations can be smaller if the powder container is meant for cosmetic blush powder. In another case, a larger size of perforations can be configured if the powder container is to be used for applying face powder.

In accordance with an embodiment, the diameter of the broad top side of inner jar 306 is approximately 36.6 mm and that of its narrow bottom side is less than approximately 35 mm. Also, in accordance with an embodiment, the height of inner jar 306 is approximately 23.04 mm. However, all the dimensions of inner jar 306 should not be construed to be limited to the numbers mentioned above. These dimensions may vary with other embodiments.

Figure 6:
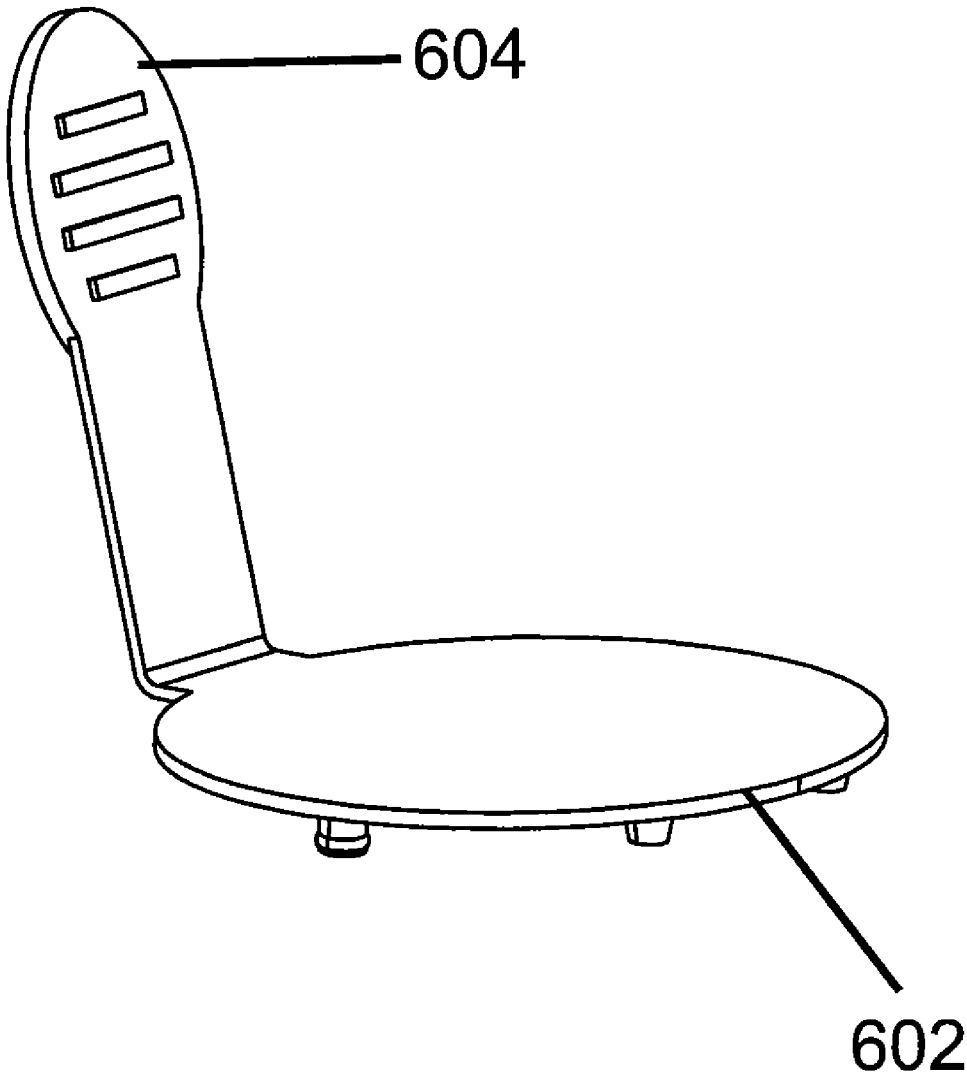
FIG. 6 illustrates a protective disc in accordance with an embodiment of the present invention.

In accordance with another embodiment of the invention, inner jar 306 is covered with a protective disc. Protective disc seals the perforations in inner jar 306 to prevent the spilling of the powder from the receptacle during handling or transportation of the powder container. The protective disc should be removed to apply the powder from the powder container in accordance with the various embodiments of the invention. In accordance with an embodiment, the protective disc may be made from polypropylene. An exemplary protective disc 602 is illustrated in FIG. 6. A tab 604 emerging from protective disc can be used to pull the disc out from the receptacle and render the perforations open for application of the powder.

While various embodiments of the present invention have been illustrated and described, it will be clear that the present invention is not limited to these embodiments only. Numerous modifications, changes, variations, substitutions and equivalents will be apparent to those skilled in the art without departing from the spirit and scope of the present invention as described in the claims.

What is claimed is:

1. A container for loose powder, comprising:

a receptacle for holding loose powder, the receptacle comprising a perforated panel, the receptacle having an outer wall extending from a bottom and defining an internal volume; and a cap contacting the outer wall of the receptacle and closing the internal volume, the cap comprising:

an upper section and a lower section;

a brush integrated in the cap, the brush picking powder through the perforated panel when the brush is protruded; and a rotational apparatus to perform the protrusion and the retraction of the brush; wherein the upper section and the lower section of the cap are connected through the rotational apparatus and wherein the upper section and the lower section of the cap are rotated with respect to each other to protrude and retract the brush wherein half the rotation of the upper section of cap with respected to the lower section causes misalignment of the upper and lower section thereby causing the initiation of protrusion or retraction of brush and wherein full rotation of the upper section of cap with respect to the lower section causes re-alignment of the upper and lower section causing the brush to be completely protruded or retracted.

2. The container of claim 1, wherein the receptacle comprises a protective disc which covers the perforated panel to prevent spilling of the powder through the perforated panel.

3. The container of claim 2, wherein in an initial position the upper and lower section are in alignment with each other.

4. The container of claim 3, wherein at least one of the upper section and the lower section of the cap comprises a brush holder, the brush holder integrating the brush into the cap.

5. A system for containing powder and for application of powder, the system comprising:

an outer jar for holding powder, the jar comprising an inner jar, wherein the inner jar is fitted inside the outer jar and the inner jar is perforated;

a cap comprising a brush, a lower section, an upper section and a rotational apparatus to perform the protrusion and the retraction of the brush, the lower section contacting the outer jar and enclosing the inner jar, the lower section comprising a seal disc, the seal disc comprising protruding channels;

a lower cap having hollow channels on the inner wall, wherein the hollow channels cover the protruding channels of the seal disc to fix the lower cap on the seal disc;

a brush holder connected to the lower cap, the brush holder integrating the brush with the cap, wherein the brush holder is a cylinder with protrusions on the side walls of the cylinder, the upper section of the cap comprising a center bar wherein the brush holder is fitted inside the center bar, the protrusions of the brush holder fitted in a groove on the wall of the center bar, the protrusions and the groove allowing the brush holder to slide inside the center bar;

an upper cap connected to the center bar, wherein rotation of the upper cap slides the brush holder inside the center bar; and wherein the upper section and the lower section of the cap are connected through the rotational apparatus and wherein the upper section and the lower section of the cap are rotated with respect to each other to protrude and retract the brush wherein half rotation of the upper section of cap with respect to the lower section causes misalignment of the upper and lower section thereby causing the initiation of protrusion or retraction of brush and wherein full rotation of the upper section of cap with respect to the lower section causes re-alignment of the upper and lower section causing the brush to be completely, protruded or retracted.

6. The system of claim 5, wherein the outer jar is covered by a bottom disc onone side.

7. The system of claim 5, wherein the inner jar is covered with a protective disc to prevent spilling of the powder through the perforations on the inner jar.

8. A method for application of loose powder from a powder container having an integrated brush, the method comprising the steps of;

removing a cap from a receptacle, the receptacle having powder and comprising a perforated panel, wherein the cap has an upper section and a lower section, the lower section extending laterally outward from the upper section engaging and closing the receptacle, the upper section and the lower section being aligned in an initial position;

rotating the upper section of the cap in a first direction to misalign the upper section and the lower section to protrude a brush comprised in the cap; twirling the protruded brush inside the receptacle over the perforated panel to pick powder from the receptacle;

applying the powder picked by the protruded brush; and rotating the upper section of the cap in the reverse direction to align the upper section and the lower section in the initial position to retract the brush in the cap.

9. The method of claim 8, wherein the rotation of the upper section of the cap in a first direction comprises re-aligning the upper section and the lower section through a 180 degree rotation of the upper section in the first direction.

10. A container for loose powder, comprising:

a jar having an outer wall extending from a bottom defining an internal volume, the receptacle having a perforated panel disposed above the bottom in the internal volume;

a cap having an exterior surface comprised of an upper section and a lower section and a rotational apparatus to perform the protrusion and the retraction of the brush, the lower section removably engaging the outer wall of the jar to enclose the internal volume, the upper section rotatable relative to the lower section;

a brush integrated in the lower section of the cap;

wherein the upper section and the lower section of the cap are connected through the rotational apparatus and wherein the upper section and the lower section of the cap are rotated with respect to each other to protrude and retract the brush wherein half rotation of the upper section of cap with respect to the lower section causes misalignment of the upper and lower section thereby causing the initiation of protrusion or retraction of brush and wherein full rotation of the upper section of can with respect to the lower section-causes re-alignment of the upper and lower section causing the brush to be completely protruded or retracted.

* * * * *